US008803738B2

(12) United States Patent
Nguyen et al.

(10) Patent No.: US 8,803,738 B2
(45) Date of Patent: Aug. 12, 2014

(54) PLANAR GRADIENT-INDEX ARTIFICIAL DIELECTRIC LENS AND METHOD FOR MANUFACTURE

(75) Inventors: Vinh N. Nguyen, Durham, NC (US); Serdar H. Yonak, Ann Arbor, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 706 days.

(21) Appl. No.: 12/209,737

(22) Filed: Sep. 12, 2008

(65) Prior Publication Data

US 2010/0066639 A1 Mar. 18, 2010

(51) Int. Cl.
*H01Q 1/38* (2006.01)
*H01Q 15/02* (2006.01)
*H01Q 19/02* (2006.01)

(52) U.S. Cl.
USPC ..... 343/700 MS; 343/753; 343/755; 343/909

(58) Field of Classification Search
USPC ..... 343/753, 910, 911 R, 700 MS, 755, 909
See application file for complete search history.

(56) References Cited

U.S. PATENT DOCUMENTS

| | | | | |
|---|---|---|---|---|
| 7,227,501 | B2 * | 6/2007 | Lange | 343/700 MS |
| 7,456,803 | B1 * | 11/2008 | Sievenpiper | 343/909 |
| 7,492,329 | B2 * | 2/2009 | Wang et al. | 343/909 |
| 7,855,691 | B2 * | 12/2010 | Yonak et al. | 343/755 |
| 2006/1020290 | | 9/2006 | Nagai | |

OTHER PUBLICATIONS

K. Awal, S. Kids, S. Mizue; "Very Thin and Flat Lens Antenna Made of Artificial Dielectrics," 2007 Korea-Japan Microwave Conference, pp. 177-180.

* cited by examiner

*Primary Examiner* — Michael C Wimer
(74) *Attorney, Agent, or Firm* — Gifford, Krass, Sprinkle, Anderson & Citkowski, P.C.

(57) ABSTRACT

A gradient index lens for electromagnetic radiation includes a dielectric substrate, a plurality of conducting patches supported by the dielectric substrate, the conducting patches preferably being generally square shaped and having an edge length, the edge length of the conducting patches varying with position on the dielectric substrate so as to provide a gradient index for the electromagnetic radiation. Examples include gradient index lenses for millimeter wave radiation, and use with antenna systems.

17 Claims, 11 Drawing Sheets

Detailed View of Lens Edge

Center Layer of Artificial Dielectric Lens

Detailed View of Lens Edge

Center Layer of Artificial Dielectric Lens

Simple Cubic

Body-Centered Cubic

Face-Centered Cubic

PLANAR GRADIENT-INDEX ARTIFICIAL DIELECTRIC LENS AND METHOD FOR MANUFACTURE

FIELD OF THE INVENTION

Examples of the invention relate to artificial dielectric materials, and applications thereof such as dielectric lenses for millimeter wave automotive radar.

BACKGROUND OF THE INVENTION

Radar systems, such as millimeter wave automotive radar, may benefit from the use of lenses or other beam modifying devices. However, conventional dielectric lenses may be bulky, difficult to manufacture, and may provide a limited range of index variations.

Metamaterials have been used at radar wavelengths. However, conventional metamaterials require high resolution lithography which may limit the wavelength applications. Further, when used near resonance losses in conventional metamaterials may be significant, and index variations may be limited.

Hence, improved lenses for use at millimeter wave and other wavelength ranges would be extremely useful.

SUMMARY OF THE INVENTION

Examples of the present invention include artificial dielectric lenses, in particular for use at millimeter wave ranges, and for use in automotive radar applications. An example artificial dielectric comprises a periodic array of conducting metal particles, such as metal patches, patterned on a dielectric substrate. The artificial dielectric comprises a plurality of unit cells, each unit cell comprising at least one metal patch. The unit cells may be arranged in a lattice array structure, for example as a square lattice. Each unit cell may include a conducting metal patch. In some examples of the present invention, the conducting metal patches are approximately square, and the edge length of the square patches may vary as a function of position so as to provide a gradient index material. Examples of the present invention include gradient index lenses for millimeter wave applications, comprising square metal patches on a dielectric substrate.

The unit cell dimensions are preferably less than the wavelength of operation, in particular less than one-fifth of a wavelength, so that the properties of the material may be determined using effective medium theory, for example as described by Smith et al, WO2006/023195, in relation to metamaterials.

By varying the dimension of conducting patches in a gradient direction, a gradient index lens may be readily obtained. Examples of the present invention include a planar artificial dielectric material comprising metal patches of varying dimension, thus having a refractive index that is a function of position. The variation of refractive index with spatial parameter may be designed according to a desired arbitrary formula. Lenses may be fabricated using conventional printed circuit board techniques, for example through the etching of metal patches on a metal coated dielectric substrate.

The use of geometrically simple metal patches, for example squares, avoids the presence of the relatively small features of the conducting metal patterns used in conventional metamaterials. Hence, an artificial dielectric lens can be fabricated using conventional multilayer printed wiring board technique. The propagation loss of the lens can be much lower than through a conventional metamaterial lens, because the artificial dielectric lens operates much further (in terms of frequency) from resonance than a metamaterial lens.

A great variation of index can be obtained by varying the parameters of the metal patches. For example, using square metal patches, an index variation ratio of 3 to 1 was obtained, comparing the highest index with lowest index within the same material. Hence, improved low loss gradient index lenses can be manufacturing using a simple and inexpensive technique.

Applications include any radar application, including automotive radar applications such as adaptive cruise control, object detection, and image recognition applications.

An example gradient index lens for electromagnetic radiation, such as millimeter wave radiation, includes a dielectric substrate, a plurality of conducting patches supported by the dielectric substrate, the conducting patches being generally square shaped and having an edge length, the edge length of the conducting patches varying with position on the dielectric substrate so as to provide a gradient index for the electromagnetic radiation. The plurality of conducting patches may be arranged so that the centers of the patches are arranged in an array on the dielectric substrate, for example a square array, and more particularly a regular square array or at the intersections of a uniformly spaced regular square grid array.

The center-to-center lateral separation of the patches may be substantially constant, the index variations being provided by variations in the edge length of the patches. Hence, the edge-to-edge separation of square patches may vary in a manner correlated with the edge length, the maximum edge length being determined by a minimum acceptable edge-to-edge separation, for example related to the resolution of a fabrication process.

The arrangement of the conducting patches on the substrate may correspond to an array of unit cells, the unit cells being square and having a side length less than ⅕ the wavelength of an operating wavelength, or the smallest wavelength of an operating range.

The dielectric substrate may comprise any suitable material, preferably non-electrically conducting at operating wavelengths. Examples include polymers, such as a liquid crystal polymer (LCP), and for millimeter wave operation a low loss LCP may be used.

A dielectric substrate may further support a radio-frequency electronic circuit, and the same printed wiring board process can be used to form interconnections for the radio-frequency electronic circuit and the plurality of conducting patches on the same substrate.

The dielectric substrate may further be used to mechanically support an antenna assembly, which may be in electrical communication with a radio-frequency electronic circuit on the dielectric substrate. For example, a ground plane may be attached to the dielectric substrate, and a patch antenna mounted proximate the ground plane. The radio-frequency electronic circuit may be operable to generate or receive millimeter-wave radiation in cooperation with the antenna assembly, the gradient index lens being used to modify the properties of received and/or transmitted radiation. The patch antenna may be mechanically associated with the dielectric substrate.

In some examples, a gradient index lens comprises a multilayer structure formed from a plurality of dielectric substrates, for example generally parallel dielectric substrates, each dielectric substrate supporting an array of conducting patches. The patch arrangement on the substrates can be configured to provide simple cubic (patches on all layers being in register), body-centered cubic (bcc), or face-centered cubic (fcc) arrangement of patches. The number of layers is not limited, but for example a multilayer structure may include between 2 and 20 layers, inclusive.

A gradient index lens may be a converging or diverging lens for millimeter-wave radiation. For a converging lens, the edge length of conducting patches (and hence index) increases along a direction from the lens edge to the lens center. For a diverging lens, the edge length may increase moving from the center to the edge, correlated with a radial distance from the center.

An example apparatus is a gradient index lens for millimeter-wave radiation, including a plurality of dielectric substrates, each dielectric substrate supporting an array of conducting patches, the conducting patches being generally square shaped and having an edge length, the edge length of the conducting patches varying with position in the gradient index lens so as to provide a gradient index for millimeter wave radiation, the gradient index lens having a center, the edge length and the index decreasing with radial distance from the center. The conducting patches being arranged in a body centered cubic arrangement. A millimeter-wave antenna and a reflector may additionally be configured so that the reflector and the gradient index lens cooperate to focus millimeter wave radiation on or from the antenna, allowing improved millimeter wave sources and receivers.

An example apparatus is a gradient index lens for millimeter-wave radiation comprising a plurality of substrates, for example generally parallel layers of low loss dielectric material, each substrate supporting a plurality of conducting patches, the conducting patches being generally square shaped and having an edge length, the edge length of the conducting patches varying with position in the gradient index lens, the conducting patches being arranged in a generally body centered cubic arrangement. For example, each dielectric substrate may support a square array or a uniformly spaced regular square grid array of conducting patches, the apparatus including first, second, and third dielectric substrates, the second dielectric substrate located between the first and third dielectric substrates, the first and third dielectric substrates supporting regular square grid arrays of conducting patches that are substantially in register, the second dielectric substrate supporting a regular square grid array of conducting patches that is offset relative to the first and third dielectric substrates so as to provide an approximately body centered cubic arrangement of conducting patches.

Examples of the present invention include planar gradient-index artificial dielectric lens for millimeter-wave automotive radar, such as a planar gradient-index lens. Examples of the present invention include artificial dielectric materials for use in any millimeter-wave application, not necessarily graded index, for example absorbers, reflectors, beam steering devices, and the like. An artificial dielectric may comprise an array of unit cells patterned on a substrate so as to achieve a particular refractive index based on the size and lattice structure of the metallic particles, such as metal patches, contained therein. A lens may be effective to collimate and direct electromagnetic waves transmitted from a simple source into a directed beam. Lenses and artificial dielectric materials may be manufactured using mm-wave RF substrates such as a liquid crystal polymer (LCP). Examples of the present invention include materials and devices configured for automotive radar, such as 77 GHz operation.

DETAILED DESCRIPTION OF THE PREFERRED EMBODIMENTS

Figure 1A:
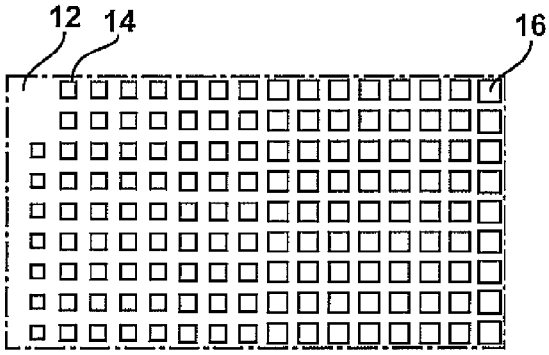
FIGS. 1A and 1B illustrate a lens, with a detailed view of the lens edge.

Examples of the present invention include artificial dielectric (AD) lenses, in particular gradient index lenses using artificial dielectric materials. A GRIN-AD lens may comprise an arrangement of square metal patches on a dielectric layer. The edge lens of the square metal patches may vary as a function of a spatial position for example along a gradient direction. In some examples, the square lens and corresponding refractive index is a maximum in a center of the lens, and decreases as a function of radial distance from the lens center. Hence refractive elements can be obtained without the necessity of a curved surface, as is conventionally required with a normal dielectric lens.

Some examples of the present invention include multiple layer structures, for example formed from a plurality of printed circuit boards. The circuit boards may be spaced apart and bonded together, and copper layers on either single layer or double layer circuit boards may be etched to obtain the desired pattern of conducting patches. The patches may be arranged in one of various arrangements, such as simple cubic (SC), body centered cubic (bcc), and face centered cubic (fcc). Surprisingly good results were obtained using the bcc arrangement of square metal patches. In some examples, a refractive index range of approximately 1.8 to approximately 5.8 was obtained which corresponds to a greater than 3 to 1 ratio of refractive index. Applications of lenses according to the present invention include use with radar antennas to obtain improved antenna systems. For example the directionality of a radar transmitter may be improved using a converging lens. For example a patch antenna may be located at the focus of a lens. Similarly a lens according to the present invention can be used to improve the performance of a radar detector.

In some examples, the refractive index of the lens is greatest at the center of the lens, and decreases as a function of radius. However in other examples, the index may be a minimum at the center and increase as a function of radius towards the outside, for example if diverging radiation is desired.

In some examples, a gradient index lens is combined with a parabolic reflector to obtain an improved radar source (or radar detector).

Examples of the present invention also include linear gradient index lenses, where the index is a function of position along a linear direction.

The use of square metal patches was found to give excellent performance. For example, the ratio of filling factors between larger and small squares is increased, and it is also possible that coupling between patches may modify the performance in an advantageous manner. Preferably, the metal patches are square, and may be arranged in a bcc arrangement. This provides a better range of refractive index than has previously been obtained using any other passive system. An example substrate may comprise a plurality of unit cells in a square array. The term "unit cells" refers to the arrangement of approximately repeating structures over the surface of the substrate. In the absence of a refractive index gradient, the unit cells may be identical over the whole of the substrate, comprising for example a square of constant edge length. However, in some examples a gradient index is desired, and in such examples the unit cell dimensions may remain approximately unchanged across the substrate, whereas the dimensions of the metal patch vary as a function of position.

In some examples of the present invention, RF electronics associated with an antenna may be integrated onto the sample printed circuit board arrangement used to provide the AD lens. This provides a compact reliable and improved system compared to the prior art.

In some examples of the present invention, the dielectric substrates may be a low loss RF substrate, in particular a liquid crystal polymer substrate.

In some examples, dynamically variable properties can be obtained through connecting patches using a switch, for example to obtain groups or rings of patches through electrical interconnection which may be turned on and off as desired. For example the use of Schottky switches may allow the dynamic selection of groups and/or rings of patches so that the properties of the lens may be modified dynamically. Hence examples of the present invention include switchable lenses, for example for beam scanning or steering applications.

The minimum and maximum sizes of the conducting patches, such as metal patches, may be determined by manufacturing tolerances. For example the patch may fill almost the entirety of the unit cell. However, a narrow gap may be required around the patch edge to avoid shorting e.g. of a metal patch with an adjacent metal patch. Similarly, the smallest possible metal patch may be a function of the smallest possible feature of the fabrication process used. However, conventional printed circuit board techniques allow excellent result for passive millimeter range imaging. High resolution etching techniques may be used for terahertz or IR applications if desired.

An advantage of lenses designed using artificial dielectrics is a relative insensitivity to operating wavelengths within an operative wavelength band. For example, metamaterials are often operated close to resonance, and considerable dispersion is observed in properties such as loss. Furthermore losses may be relatively high. In contrast, the dispersion effects may be negligible in lenses according to the present invention.

In some examples of the present invention, the refractive index may be varied in a direction normal to the layers in a multilayer structure, for example each layer comprising conducting patches on a dielectric substrate. The conducting patches may comprise metal, such as copper, gold, silver, or other metal, a conducting polymer, or other conducting material. The patches may be obtained by etching of conventional copper-clad printed wiring boards, and either single-sided or double-sided boards may be used. For example a structure may comprise a plurality of dielectric substrates in a stack, and the index may change going from one layer to an adjacent layer. Applications of such structures include fabrication of quarter wavelength matching layers and gradient matching layers within the lens. For example the outermost layers of a multilayer structure may provide an index matching layer to reduce reflection from the lens.

Examples of the present invention include lenses with an operating frequency of approximately 77 GHz, for example in the frequency range of 10 GHz to 100 GHz, more particularly 70 GHz to 80 GHz. Applications include radar applications such as automotive radar applications including adaptive cruise control, automotive radar imaging at millimeter and optionally terahertz wavelengths, and other radar applications.

Figure 1B:
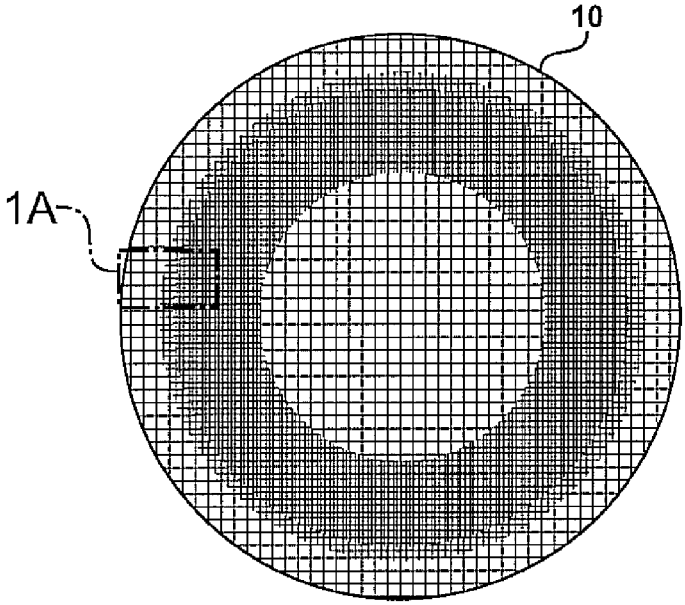

FIGS. 1A and 1B illustrate an example lens. FIG. 1B shows a generally circular lens 10 comprising a plurality of square metal patches on a dielectric substrate. In this example, the dielectric substrate is not shown for conciseness. FIG. 1A shows a detailed view of the lens edge at 12, including patches such as 14 and 16. In this example, the edge length of the squares decreases towards the edge of the lens, so that square 16 is larger than square 14.

A bcc arrangement may be implemented using only two unique mask layers. A possible dielectric substrate is Rogers Ultralam™ 3000 series (Rogers Corporation, AZ) printed wiring boards (PWB). Example lenses were designed with 20 metal layers, but the number of metal layers and dielectric substrates is not limited by this example, and may be any number to obtain desired properties.

Figure 1C:
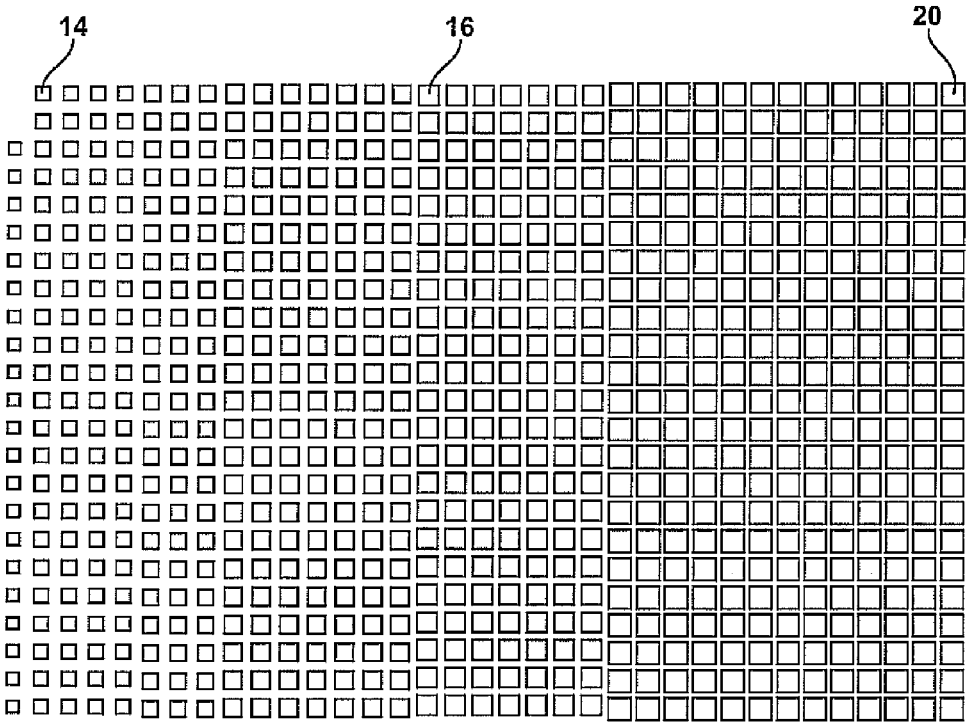
FIG. 1C further illustrates an array of square metal patches from a planar lens.

FIG. 1C shows another representation of the spatial distribution of square sizes on a substrate. Here, square 20 is closer to the center of the lens than square 16 and hence is correspondingly larger.

Figures 2A, 2B:
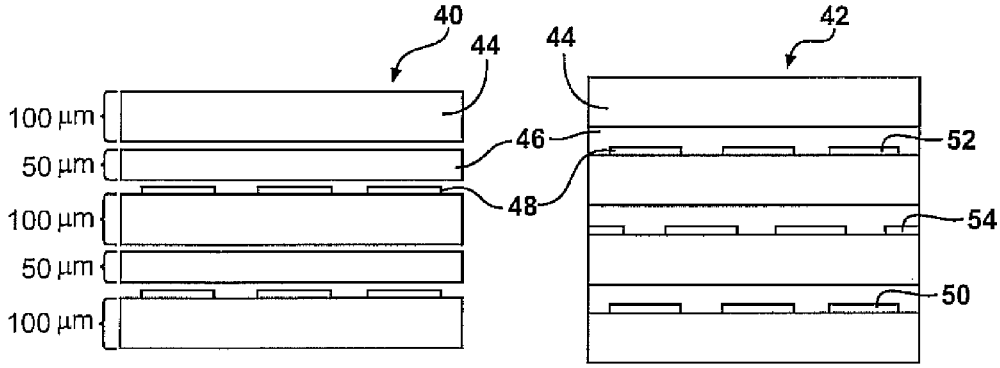
FIGS. 2A and 2B illustrate a multilayer circuit board approach to lens manufacture.

FIGS. 2A and 2B illustrate a passive lens fabricated using multilayer printed circuit board techniques. The components are shown generally at 40 in FIG. 2A, comprising a dielectric substrate 44, bonding layer 46, and square metal patches such as 48. In this example, the circuit board is Ultralam™ 3850, and the bonding layer is Ultralam™ 3908 bond ply. However, other circuit board materials and bonding layers may be used. Preferably, the dielectric substrate 44 is a low loss material at operating wavelengths, such as a liquid crystal polymer. In this example, the dielectric substrate is approximately 100 microns thick, and the bonding layer is approximately 50 microns thick. For example, the dielectric substrate may have a thickness in the range 1 micron-5 mm, such as 10 microns-1 mm. Inter-substrate spacings may be in the range 1 micron-1 mm. These distances are exemplary and not limiting.

FIG. 2B shows the layers as assembled, with a body centered cubic arrangement of metal patches. In this example the metal patches of alternating layers for example 50 and 52 are in approximate register and the intervening layer patches such as 54 are offset so as to be in the bcc arrangement.

Figure 3:
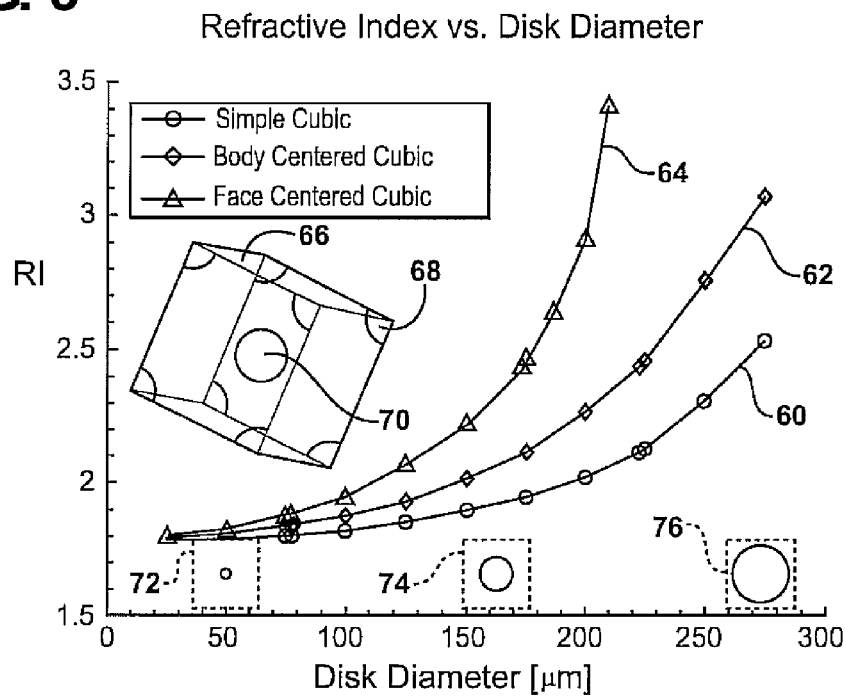
FIG. 3 shows refractive index versus disk diameter for an AD (artificial dielectric) lens.

FIG. 3 shows refractive index versus disk diameter for an arrangement of metal disks. In this example, simple cubic, bcc, and fcc arrangements at 60, 62, and 64 respectively. The inset at 66 shows a bcc arrangement. Patches such as 68 present at the corner of the illustrated cube and a patch 70 is present at the center. The lower portion of FIG. 3 illustrates the relative change in disk diameter, the small disks being present at 72, relatively medium sized at 74 and almost filling the unit cell at 76.

Figure 4A:
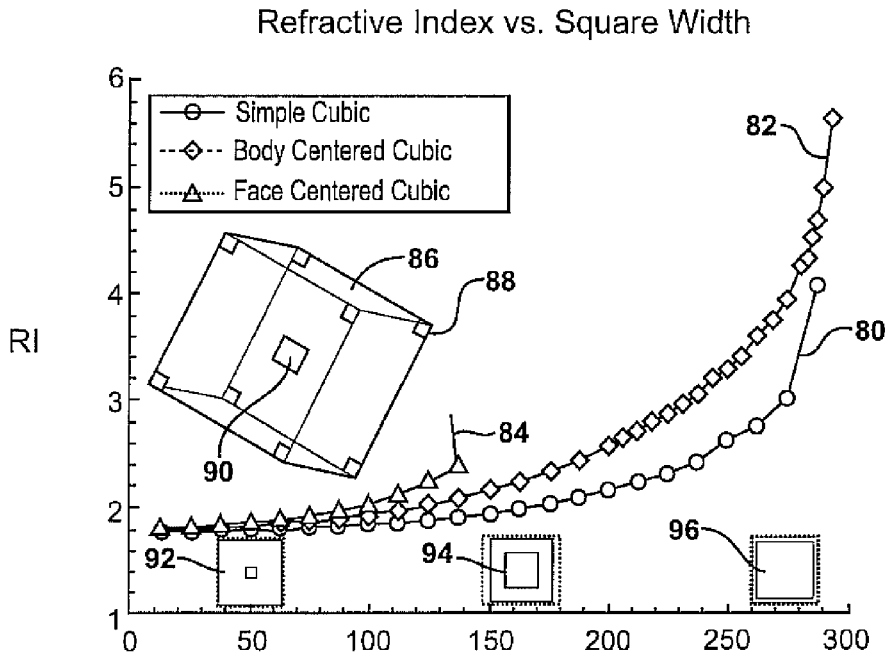
FIG. 4A shows refractive index versus square width for AD lenses comprising square metal patches.

FIG. 4A illustrates refractive index for square width for arrays of square metal patches. The graphs show simple cubic, bcc, and fcc arrangements at 80, 82, and 84 respectively. The inset 86 illustrates bcc arrangements of metal patches with a central patch 90 and patches at the corners of the unit cell at 88. Similar to FIG. 3, the illustrations near the bottom of the figure show the relative change in square width, the small squares at 92, midsized at 94, and large at 96.

Figure 4B:
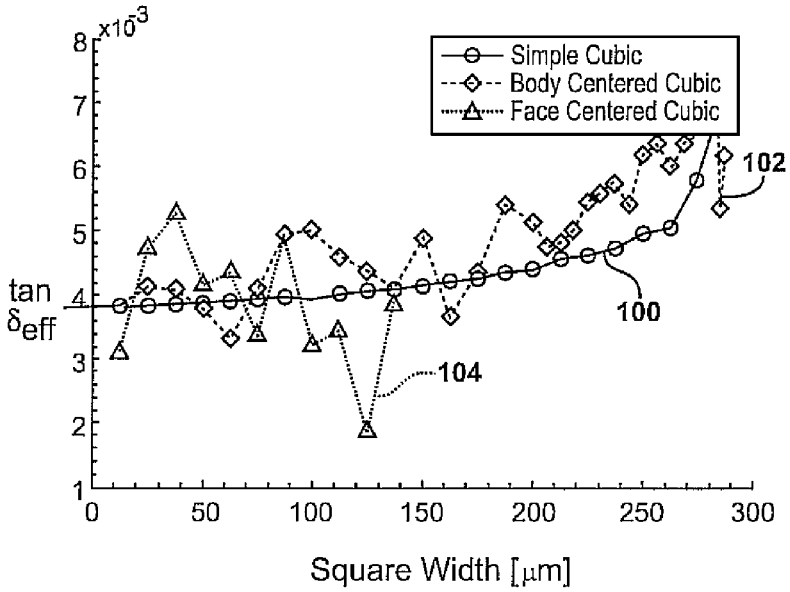
FIG. 4B shows losses for the lenses of FIG. 4A.

FIG. 4B shows the variation of loss with edge size. The Y axis is the tangent of the effective loss angle from $1\times10^3$ to $8\times10^3$, the X axis being the square width in microns. The graph shows that the loss is very low in these structures.

Properties may be determined using Ansoft (Pittsburgh, Pa.) HESS full-wave electromagnetic simulation. A comparison of artificial dielectric configurations is given below in Table I for 50 μm critical dimension (an example fabrication resolution limit). The results show surprisingly excellent results for the square patches, in particular for the body centered cubic (bcc) arrangement of square patches. The resolution limit reduces the maximum index available, but the range of index for the bcc arrangement of square patches is much greater than any other configuration.

TABLE I

Index range for various arrangements.

| Patch type | Lattice | Minimum RI | Maximum RI | Index Change |
|---|---|---|---|---|
| Disk | Simple | 1.785 | 2.306 | 0.521 |
| Disk | Body centered | 1.802 | 2.754 | 0.952 |
| Disk | Face centered | 1.819 | 2.218 | 0.399 |
| Square | Simple | 1.794 | 2.620 | 0.826 |
| Square | Body centered | 1.813 | 3.284 | 1.471 |
| Square | Face centered | 1.818 | 2.109 | 0.291 |

Figure 5:
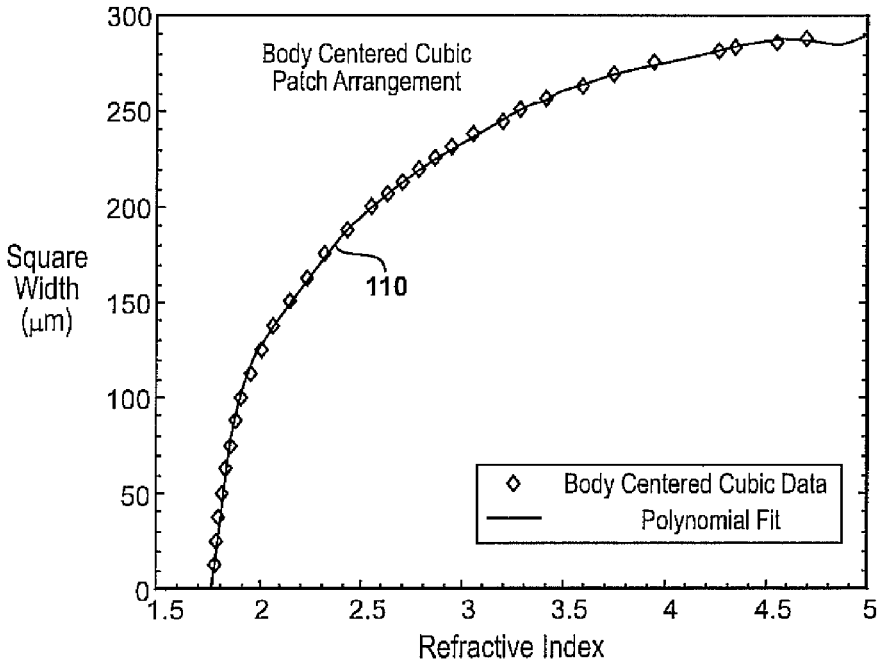
FIG. 5 shows the dependency of refractive index against square width.

FIG. 5 shows the variation of refractive index against square width. The diamonds represent data and these were fitted by a tens order polynomial shown at 110. This curve can be used for designing an artificial dielectric lens.

Figure 6:
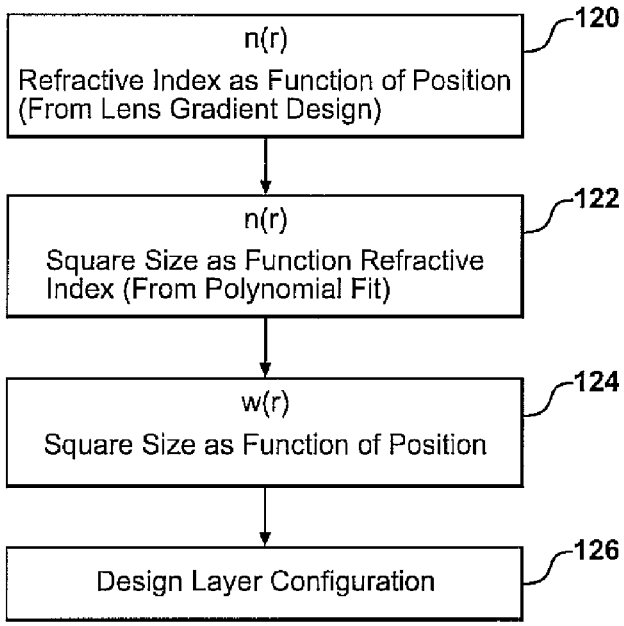
FIG. 6 is a flowchart for layer design of an AD lens.

FIG. 6 is a flowchart illustrating a possible approach to designing a lens. The desired refractive index n(r) represents the refractive index as a function of position. This may be obtained from lens gradient design equations well known in the arts. This step is shown at 120.

Block 122 corresponds from using a polynomial fit, such as the one shown in FIG. 5, to convert the desired refractive index curve to a square size curve. In examples illustrated, the refractive index increases with square size, but the relationship is not linear.

Box 124 corresponds to obtaining the function w(r), the square size as a function of position, using the graph of square size as a function of refractive index.

Box 126 corresponds to designing the layer configuration using the function w(r) obtained at 124. This may be the design of a mask for the etching of a conventional copper clad circuit board.

An example lens design equation and index design equation are:

$$n(r) = n_{\max} - \frac{\sqrt{r^2 + f^2} - f}{d} \tag{1}$$

$$n(r) \approx n_6 r^6 + n_4 r^4 + n_2 r^2 + n_0 \tag{2}$$

where:

$$n_6 = -\frac{1}{16df^5} = -5.116\times10^{-10} \quad n_2 = -\frac{1}{2df} = -3.315\times10^{-3}$$

$$n_4 = \frac{1}{8df^3} = 9.210\times10^{-7} \quad n_0 = 3.3941.$$

Figure 7A:
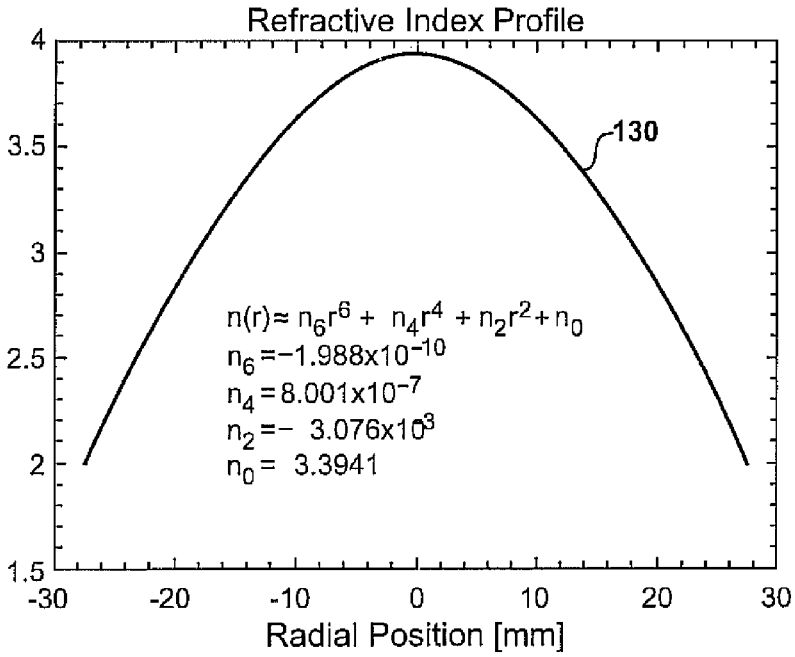
FIG. 7A shows an example refractive index profile.

FIG. 7A shows a possible refractive index profile at 130. The radial position is 0 at the center of the lens. As shown, the index profile is symmetrical, maximum at the center of the lens, in this case near 4, and then falling to a value of approximately 2 at the edges of the lens. Hence an index ratio of 2 to 1 approximately is obtained.

Figure 8A:
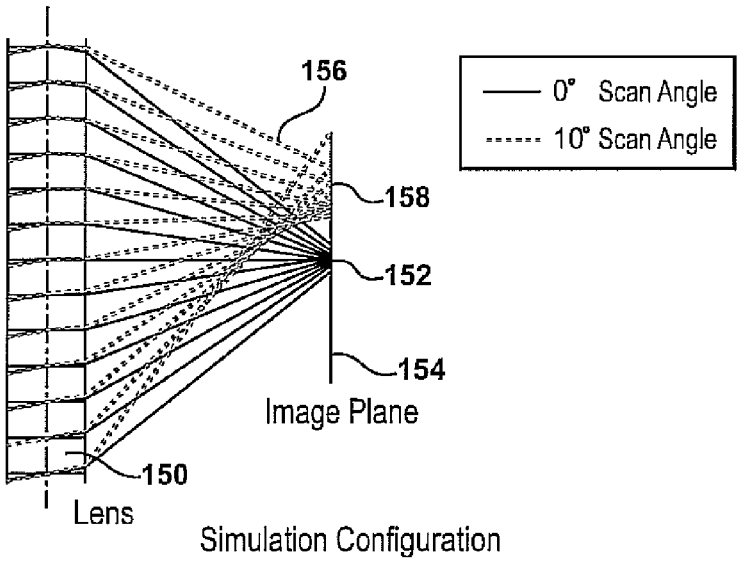
FIGS. 8A and 8B illustrate simulated lens performances for on axis and off axis incident radiation.
Figure 8B:
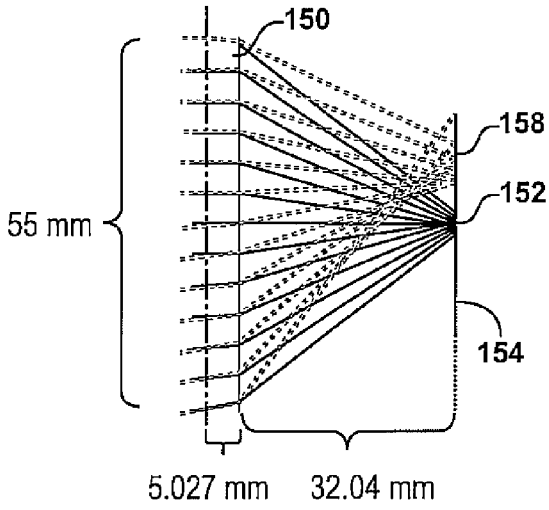

FIG. 8A is a simulation of lens performance for on axis incident radiation and off axis incident radiation with a scan angle of 10 degrees. On axis radiation is focused to a point at 152 on image plane 154. Off axis radiation 156 is focused at 158 on the image plane. FIG. 8B is a similar illustration showing dimensions used. However the dimensions illustrated are exemplary and other values may be used.

Lens design characteristics are given in Table II below. The values are exemplary and not limiting.

TABLE II

Lens design parameters

| Characteristic | Variable | Value |
|---|---|---|
| Focal length | f | 32.036 mm |
| Lens thickness | d | 5.027 mm |
| Lens radius | r (max) | 26.7 mm |

In some examples of the present invention, the spatial distribution of square edge length is radially symmetric, though arbitrary variations can be designed as required.

Figure 9A:
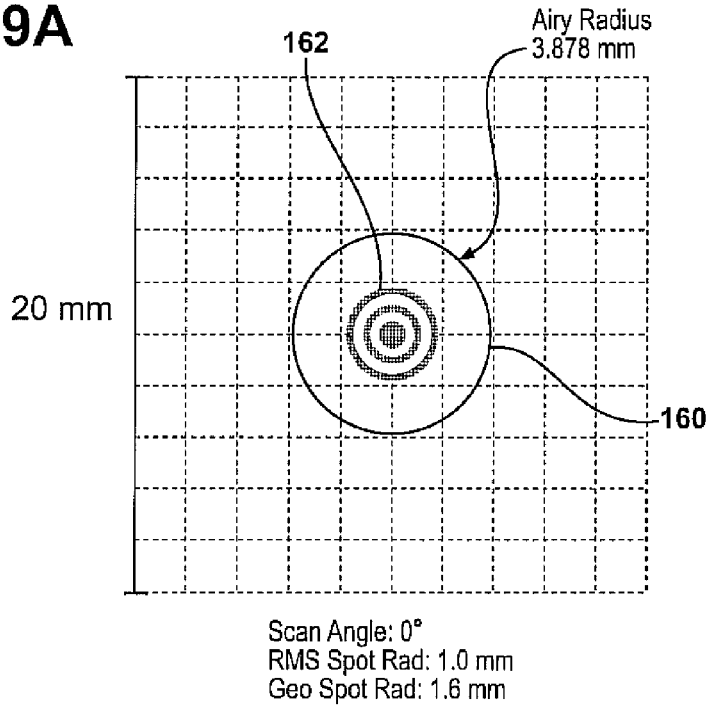
FIGS. 9A and 9B show spot diameters obtained for the AD lenses.

FIG. 9A shows the obtained focal spot 162 compared to the Airy radius 160. The lens performance was excellent, the image spot being within the airy radius. In this example, FIG. 9A corresponds to normal radiation having a scan angle of 0, the RMS spot radius was 1 millimeter, the geometric spot radius was 1.6 millimeters, and the Airy radius was approximately 3.9 millimeters.

Figure 9B:
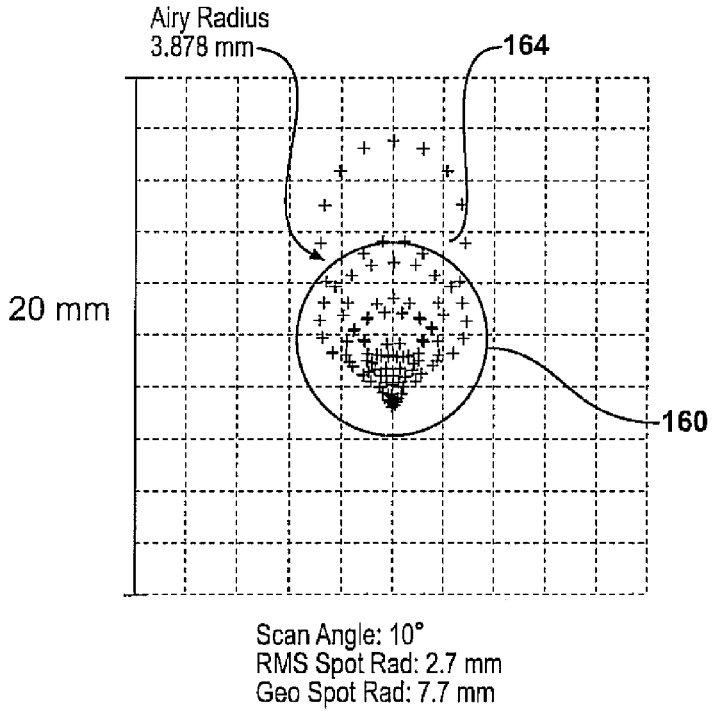

FIG. 9B shows the spot radius increasing as the incident radiation is off axis with a scan angle of 10 degrees. The RMS spot radius was 2.7 millimeters and the geometric spot radius was 7.7 millimeters.

Figure 10A:
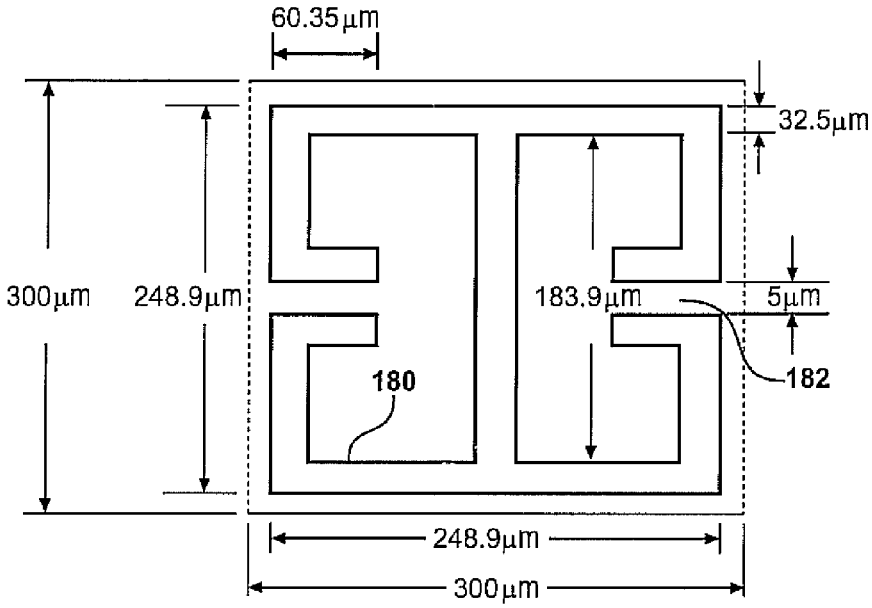
FIGS. 10A and 10B illustrate, for comparison, the performance of an ELC metamaterial unit cell.

FIG. 10A shows a metamaterial for comparison. The metamaterial comprises the ELC resonator 180 on a dielectric substrate. The unit cell dimensions are similar to the ones used in some examples of the present invention. However the performance of the metamaterial is highly dependent on the capacitive gap 182, in this example 5 microns. It can be difficult to obtain suitable high resolution for creation of such patterns for millimeter wave applications, and microfabrication techniques are required. Hence, an advantage of the artificial dielectric materials of the present invention is the lack of such critical fine resolution features, allowing conventional PWB processing. The minimum resolution may be much greater than that required for metamaterial fabrication, for example greater than 10 microns, such as the approximately 50 microns for a typical commercial PWB process.

Figure 10B:
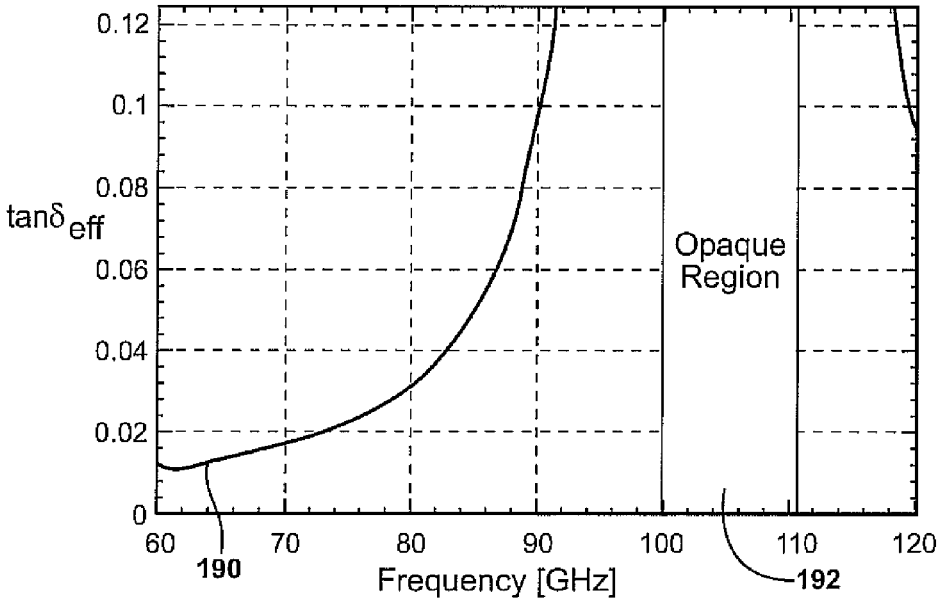

FIG. 10B illustrates the loss tangent as a function of frequency for the metamaterial of FIG. 10A. There are two features of this graph. In contrast to the artificial dielectric lens, the loss tangent is greater, at larger values approximately 100 times as great as that shown in FIG. 4B. Furthermore the loss tangent shows significant dispersion. Hence performance varies with frequency in a manner that may be highly undesirable. In contrast the AD lenses of the present invention show relatively small dispersion.

For example artificial dielectric lens materials, the dispersion curve ($\Delta n/\Delta f$) varies from 1.5E-5/GHz to 0.0026/GHz for the range 76 GHz to 77 GHz. The refractive index range available for a standard commercial PWB fabrication process is approximately 1.813 to 3.284 for bcc square patches, and $\tan(\delta_{eff})$ ranges from 0.0038 to 0.0073. In contrast, a metamaterial lens for configured for the same wavelength range requires microfabrication techniques to create the ELC (electrically-coupled inductor-capacitor) resonators, $\tan(\delta_{eff})$ ranges is approximately 10 times greater than for the artificial dielectric materials, and the refractive index range available is approximately 2.66 to 2.86 for $\tan(\delta_{eff})<0.04$.

Figure 11A:
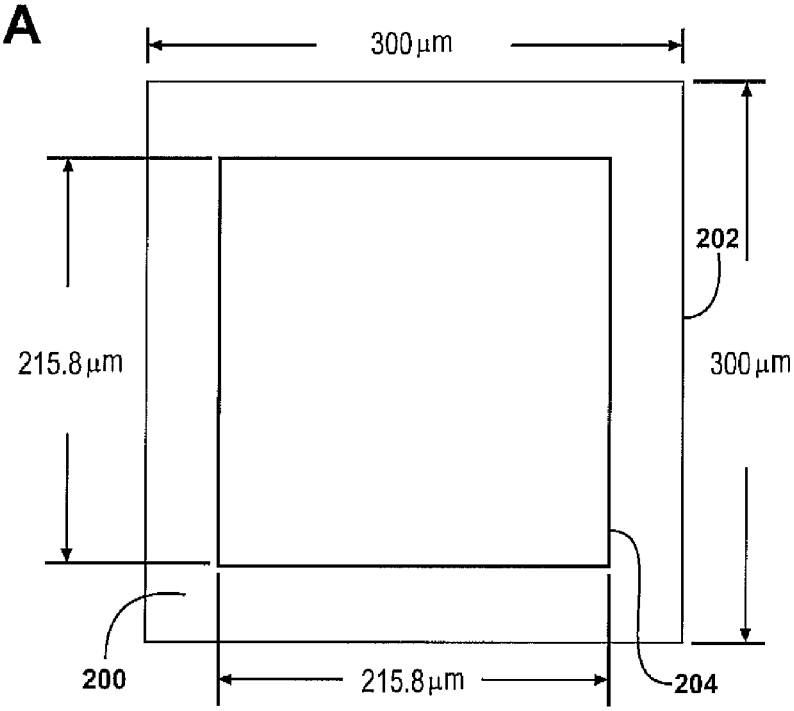
FIG. 11A illustrates a square metal patch within a unit cell.
Figure 11B:
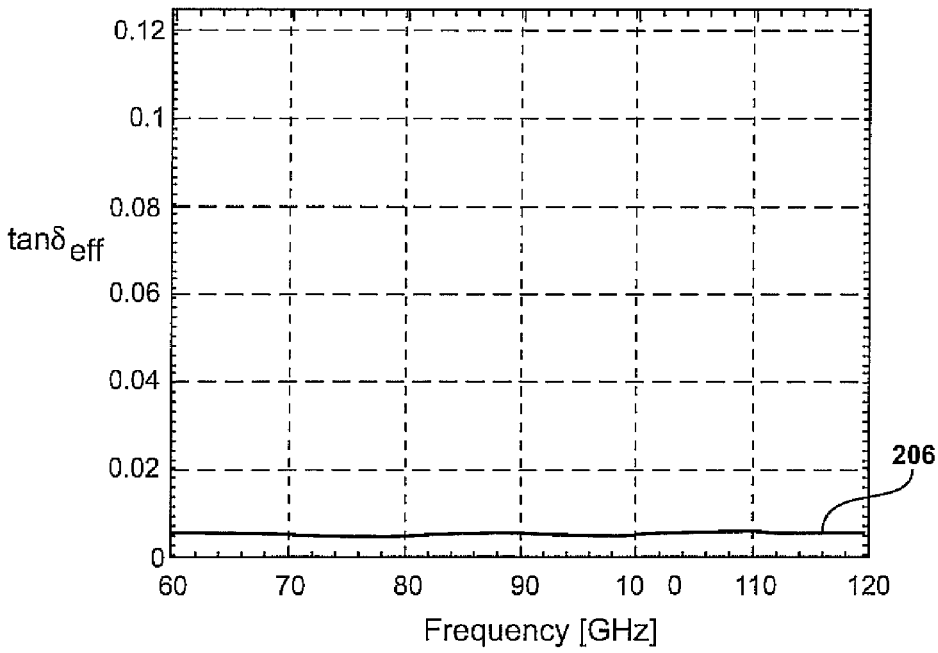
FIG. 11B shows the excellent low loss performance of a lens comprising the unit cell of FIG. 11A.

FIG. 11A shows a unit cell having outside dimension 202 and square metal patch 204. The unit cell 200 has an outer dimension of approximately 300 microns square, the metal patch having an inner dimension of 215.8 microns. The technology required to print such a structure is less challenging than that for FIG. 10A. Clearly the metal patch of FIG. 11A does not possess the fine and highly critical structures of FIG. 10A. FIG. 11B shows the loss tangent as a function of frequency. In this example the loss tangent shows no significant dispersion across the frequency band between 60 and 120 gigahertz (GHz). This includes typical automotive radar frequencies, for example 77 GHz. For all frequencies, the loss tangent 206 is less than 0.01 and furthermore varies by less than 20% over the frequency range.

Figure 12:
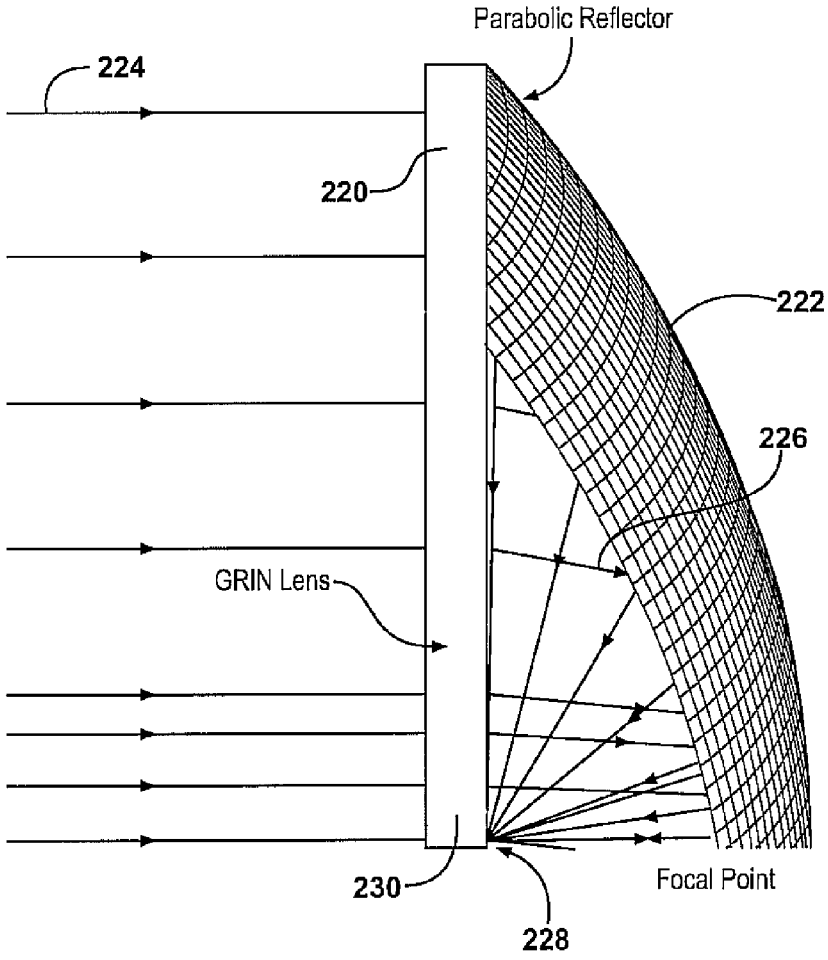
FIG. 12 shows a combination of a gradient index lens and a parabolic reflector.

FIG. 12 shows an arrangement comprising gradient index lens 220, and parabolic reflector 222. The assembly may extend downwards further than that shown, for example having a lower half (not shown) that is a mirror image of that illustrated. Incident radiation 224 passes through the gradient index lens and is focused by the parabolic reflector to a focal point 228. This arrangement is extremely useful for radar source and radar detector applications, including applications that combine transmission and detection of radiation. In other examples, the reflector may be generally bowl shaped or otherwise curved, such as hemispheric or other spherical section, other conic section, or have a profile approximating a parabola or other curved surface.

In some examples of the present invention, the spatial distribution of index deviates from radial symmetry so as to compensate for aberrations of the reflector. An improved reflector-gradient index lens comprises a lens having an index spatial distribution deviating from radial symmetry so as to compensate for lens defects.

In this example, the gradient index lens has a maximum refractive index at the lower end of the figure, for example within region 230, and a minimum refractive index at the upper end, for example within region 232. The figure shows the parabolic reflector and gradient index lens approximately in contact of the upper end, however this is not necessary.

In some examples, a planar reflector may be used, and the gradient index lens used to provide beam convergence.

Figure 13A:
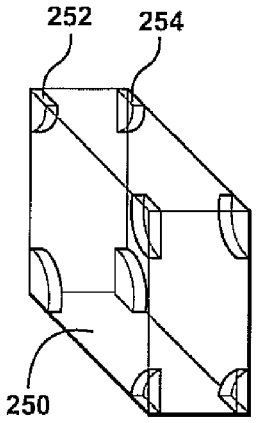
FIGS. 13A-13C illustrate simple cubic, body centered cubic, and face centered cubic arrangements.

FIG. 13A shows a simple cubic (sc) arrangement of metal patches at 250, with patches 254 and 252 at the corners. For example 252 and 254 may be metal patches in register on adjacent dielectric substrates.

Figure 13B:
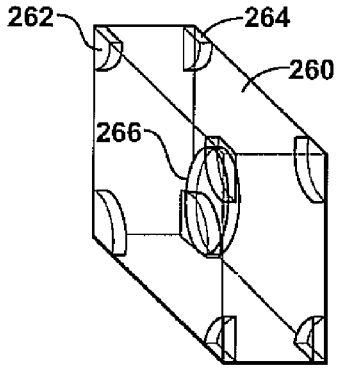

FIG. 13B shows a body centered cubic (bcc) arrangement of metal patches at 260, having patches 262 and 264 at the corners and a patch 266 in the center of the illustrated portion. For example 262 and 264 may be in register patches on alternating substrates, with the patch 266 being formed on an intervening substrate.

Figure 13C:
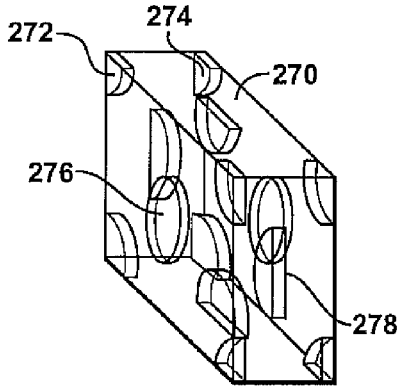

FIG. 13C shows a face centered cubic (fcc) arrangement at 270 with patches such as 272 and 274 at the corners and patches 276 and 278 at the center of the illustrated faces. In this example patch 276 may be supported by the same substrate as supports 272. The patch 278 may be supported on a substrate between those that support 272 and 274.

Figure 14:
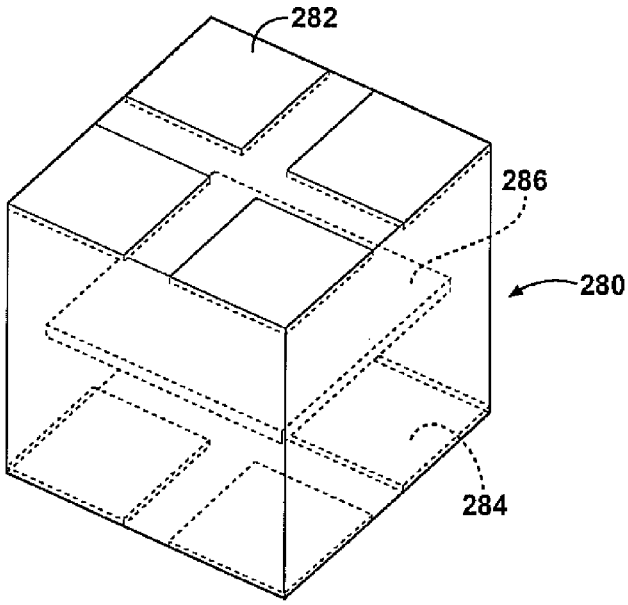
FIG. 14 is a further illustration of a body-centered cubic unit cell.

FIG. 14 shows an arrangement of patches such as 282 and 284 which are shown substantially in register, with an intervening patch 286. This arrangement is a body centered cubic arrangement. One quarter of the patches at the corners are shown in this illustration. The illustrated portion 280 is a small portion of the total lens.

Hence, a gradient index lens for electromagnetic radiation includes a dielectric substrate, a plurality of conducting patches supported by the dielectric substrate, a patch dimension (such as edge length or diameter) of the conducting patches varying with position on the dielectric substrate so as to provide a gradient index for the electromagnetic radiation. Examples include gradient index lenses for millimeter wave radiation, and use with antenna systems.

Conducting patches may be square, rectangular (for example, for anisotropic materials), triangular, circular, hollow (e.g. ring-shaped or empty-centered square), or other geometric shape. Conducting patches may include stripes or other forms. Examples described herein using metal or other conducting patches may be designed using analogous approaches using other forms of conducting particles, such as rods, disks, spheres, or other forms.

The substrate may be rigid, or in other examples may be flexible and/or conformed to a surface. The gradient index lens may be attached to an automobile and used to control radar beams for one or more automotive applications.

The invention is not restricted to the illustrative examples described above. Examples described are exemplary, and are not intended to limit the scope of the invention. Changes therein, other combinations of elements, and other uses will occur to those skilled in the art. The scope of the invention is defined by the scope of the claims.

Having described our invention, we claim:

1. An apparatus, the apparatus being a gradient index lens for electromagnetic radiation, the apparatus including:

a dielectric substrate;

a plurality of conducting patches, each patch having a continuous solid metal surface, formed as a square, supported by the dielectric substrate, the conducting patches each having centers located at intersections of a uniformly spaced regular square grid array arrangement on the dielectric substrate, each metal square having an edge length varying with position on the dielectric substrate, so as to provide a gradient index for the electromagnetic radiation.

2. The apparatus of claim 1, the regular square grid array arrangement of the conducting patches on the dielectric substrate corresponding to an array of unit cells, the unit cells being square and having a side length less than ⅕ the wavelength of an operating wavelength.

3. The apparatus of claim 1, the apparatus being a gradient index lens for millimeter wave radiation.

4. The apparatus of claim 3, the dielectric substrate comprising a liquid crystal polymer.

5. The apparatus of claim 3, the dielectric substrate further supporting a radio-frequency electronic circuit, an etched conducting layer on the dielectric substrate providing interconnections for the radio-frequency electronic circuit and the plurality of conducting patches.

6. The apparatus of claim 5, the dielectric substrate further supporting an antenna assembly in electrical communication with the radio-frequency electronic circuit, the radio-frequency electronic circuit operable to generate or receive millimeter-wave radiation in cooperation with the antenna assembly.

7. The apparatus of claim 6, the antenna assembly comprising a patch antenna mechanically associated with the dielectric substrate.

8. The apparatus of claim 1, the apparatus being a multilayer structure formed from a plurality of dielectric substrates, each dielectric substrate supporting the regular square grid array arrangement of the conducting patches.

9. The apparatus of claim 8, the multilayer structure including between 2 and 20 layers.

10. The apparatus of claim 8, the conducting patches being arranged in a three-dimensional body-centered cubic (bcc) arrangement.

11. The apparatus of claim 1, the apparatus being a converging lens for millimeter-wave radiation, the converging lens having a lens center and a lens edge, the edge length of the metal squares increasing along a direction from the lens edge to the lens center.

12. An apparatus, the apparatus comprising a gradient index lens for millimeter-wave radiation, the gradient index lens including a plurality of dielectric substrates;

each dielectric substrate supporting an array of conducting patches, each of the conducting patches having a continuous solid metal surface formed as a square, the conducting patches having centers located at intersections of a uniformly spaced regular square grid array arrangement on the dielectric substrate, each metal square having an edge length, varying with position in the gradient index lens so as to provide a gradient index for millimeter wave radiation, the gradient index lens having a center, the edge length and the index decreasing with radial distance from the center.

13. The apparatus of claim 12, the conducting patches being arranged in a body centered cubic arrangement.

14. The apparatus of claim 12, further including a millimeter-wave antenna and a reflector, configured so that the reflector and the gradient index lens cooperate to focus millimeter wave radiation on the antenna.

15. The apparatus of claim 14, the apparatus being a millimeter wave source.

16. An apparatus, the apparatus being a gradient index lens for millimeter-wave radiation, the apparatus comprising:

a plurality of dielectric substrates;

each dielectric substrate supporting a plurality of conducting patches, each patch having a continuous solid metal surface, formed as a square, the conducting patches having centers located at intersections of a uniformly spaced regular square grid array arrangement on the dielectric substrate, each metal square having an edge length, varying with position in the gradient index lens, the conducting patches being arranged in a three-dimensional body centered cubic arrangement.

17. The apparatus of claim 16, each dielectric substrate supporting a regular square grid array of conducting patches, the apparatus including first, second, and third dielectric substrates, the second dielectric substrate located between the first and third dielectric substrates, the first and third dielectric substrates supporting regular square grid arrays of conducting patches that are substantially in register, the second dielectric substrate supporting an offset regular square grid array of conducting patches that is offset relative to the first and third dielectric substrates so as to provide the three-dimensional body centered cubic arrangement of conducting patches.

* * * * *